US005789997A

United States Patent [19]

Dekker

[11] Patent Number: 5,789,997

[45] Date of Patent: Aug. 4, 1998

[54] BYPASSABLE WILKINSON DIVIDER

[75] Inventor: André P. Dekker, Oulu, Finland

[73] Assignee: Nokia Telecommunications Oy, Espoo, Finland

[21] Appl. No.: 776,758

[22] PCT Filed: May 31, 1996

[86] PCT No.: PCT/FI96/00325

§ 371 Date: Feb. 6, 1997

§ 102(e) Date: Feb. 6, 1997

[87] PCT Pub. No.: WO96/41396

PCT Pub. Date: Dec. 19, 1996

[30] Foreign Application Priority Data

Jun. 7, 1995 [FI] Finland ..... 952796

[51] Int. Cl.[6] ..... H01P 5/12

[52] U.S. Cl. ..... 333/127; 333/128

[58] Field of Search ..... 333/104, 101, 333/127, 128

[56] References Cited

U.S. PATENT DOCUMENTS 3,904,990 9/1975 La Rosa ..... 333/128

4,616,196 10/1986 Sharma ..... 333/104 X 4,901,042 2/1990 Terakawa et al. ..... 333/127

FOREIGN PATENT DOCUMENTS 0095808 12/1983 European Pat. Off. .

4241148 A1 6/1993 Germany .

3640937 C2 9/1995 Germany .

*Primary Examiner*—Paul Gensler

*Attorney, Agent, or Firm*—IP Group of Pillsbury Madison & Sutro LLP

[57] ABSTRACT

A power divider/combiner which can be installed flexibly, with small changes either as a divider/combiner or as a lossless transmission line. The configuration of the power divider/combiner into a lossless transmission line is realized by a parallel connection of two non-symmetrical transmission lines which usually have different impedances. One of the transmission lines is a branch present in a Wilkinson divider, and the other is an extra branch formed inside the divider/combiner.

10 Claims, 4 Drawing Sheets

BYPASSABLE WILKINSON DIVIDER

This application is the national phase of international application PCT/ FI96/ 00325 filed May, 31, 1996 which designated the U.S.

BACKGROUND OF THE INVENTION

The invention relates to high-frequency engineering, more exactly to power dividers used in microwave and radio engineering.

On high frequencies, especially in microwave and radio engineering, it is often necessary to split a signal into two or more output ports or to combine several signals into one output port. In some solutions the same switching device has to be used either as a power divider from one input port into two output ports or as a lossless transmission line from one input port into one output port as required at each time. This is conventionally implemented by selection devices, such as bridges, placed on circuit boards. For example, a surface-mounted resistor of zero ohms can operate as a bridging component suitable for industrial mass production. Standard junction lines (also conventionally called bond wires) can also be used.

One generally used passive switching device is a so-called Wilkinson divider. The operation of a standard Wilkinson divider appears from FIG. 1A. The figure shows a situation in which the signal splits from one input port into two output ports. With respect to the present invention, the divider can be used also in the opposite way for combining a signal from two input ports into one output port.

When operating as a power divider, the Wilkinson divider comprises an input port IN, output ports OUTI and OUT2, a T-junction 1, a transmission line 2 connecting the input port IN and the output port OUT1, and a transmission line 3 connecting the input port IN and the output port OUT2. The output ports OUT1 and OUT2 are further connected by a resistor R. The length of the transmission lines is a quarter of wavelength.

The characteristic impedance of the input port IN is $Z_0$. The characteristic impedances of the output ports OUTI and OUT2 are $Z_1$ and $Z_2$, respectively. In a simple case, when $Z_0=Z_1=Z_2$, the characteristic impedance of the transmission lines is $Z_0\sqrt{2}$ and the impedance of the resistor R is $2Z_0$.

In a general case, when $Z_0=Z_1=Z_2$ does not necessarily hold true, the characteristic impedance of the transmission line 2 is $\sqrt{2Z_0Z_1}$ and, correspondingly, the characteristic impedance of the transmission line 3 is $\sqrt{2Z_0Z_2}$ The impedance of the resistor R is then $2\sqrt{Z_1Z_2}$.

A known arrangement for transforming the Wilkinson divider into a lossless transmission line is disclosed in FIGS. 1A, 1B, 2A and 2B. The circuit in FIG. 1B comprises a transmission line 5 with respect to FIG. 1A and bridging devices B1 to B5. FIG. 2A shows how the Wilkinson divider thus transformed is transformed into a Wilkinson divider according to FIG. 1A. In this case, the resistor R and the bridges B1, B4 and B5 are installed, but not the bridges B2 and B3. The transmission line 5 has in this case no effect on the operation of the divider.

It is shown in FIG. 2B how the Wilkinson divider is bypassed, that is, transformed into a lossless transmission line. In this case, the resistor R is not installed, nor the bridges B1, B4 and B5. When only the bridges B2 and B3 are installed, the circuit shown in FIG. 2B is a lossless transmission line between the input port IN and the output port OUT1.

A disadvantage of the circuit according to FIG. 1B is e.g., the great number (five in this embodiment) of bridging places operating as selection devices and the great number of installed bridges (three in divider use, two as a transmission path). A further disadvantage of the prior art circuit is that the bridges B2 and B3 required for operating as a transmission path cannot be easily produced with small stray impedances since they combine wide lines. Another disadvantage of the prior art circuit becomes evident when the input port IN and the output ports OUTI and OUT2 are not opposite to one another, especially when the Wilkinson divider is folded to reduce its size. Especially in cases such as this, it is difficult or even impossible to fit a wide transmission line within the divider. Furthermore, the arrangement cannot be used at all when the divider is simultaneously being used as an impedance adapter, that is, $Z_1 \neq Z_0$.

SUMMARY OF THE INVENTION

The object of the present invention is to provide a power divider which can be installed flexibly, with small changes either as a divider or as a lossless transmission line and which does not share the problems associated with the prior art arrangement described above. The object is achieved with the arrangement according to the characterizing part of an arrangement in which the configuration of the power divider into a lossless transmission line is realized by a parallel connection of two non-symmetrical transmission lines which usually have different impedances. One of the transmission lines is a branch present in the Wilkinson divider and the other is an extra branch formed inside the divider.

BRIEF DESRIPTION OF THE DRAWINGS

The preferred embodiment of the invention is explained further in the following with reference to the attached drawings in which.

DETAILED DESCRIPTION

Figure 1A:
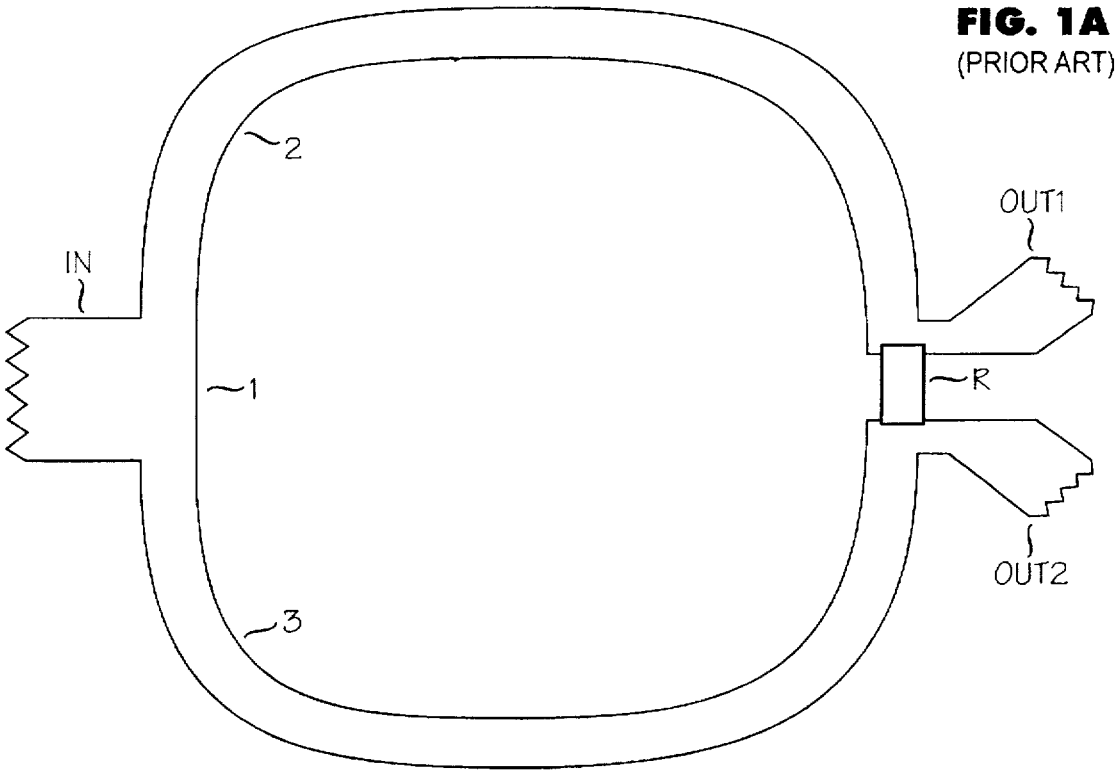
FIG. 1A (PRIOR ART)
FIG. 1A shows a standard Wilkinson divider.
Figure 1B:
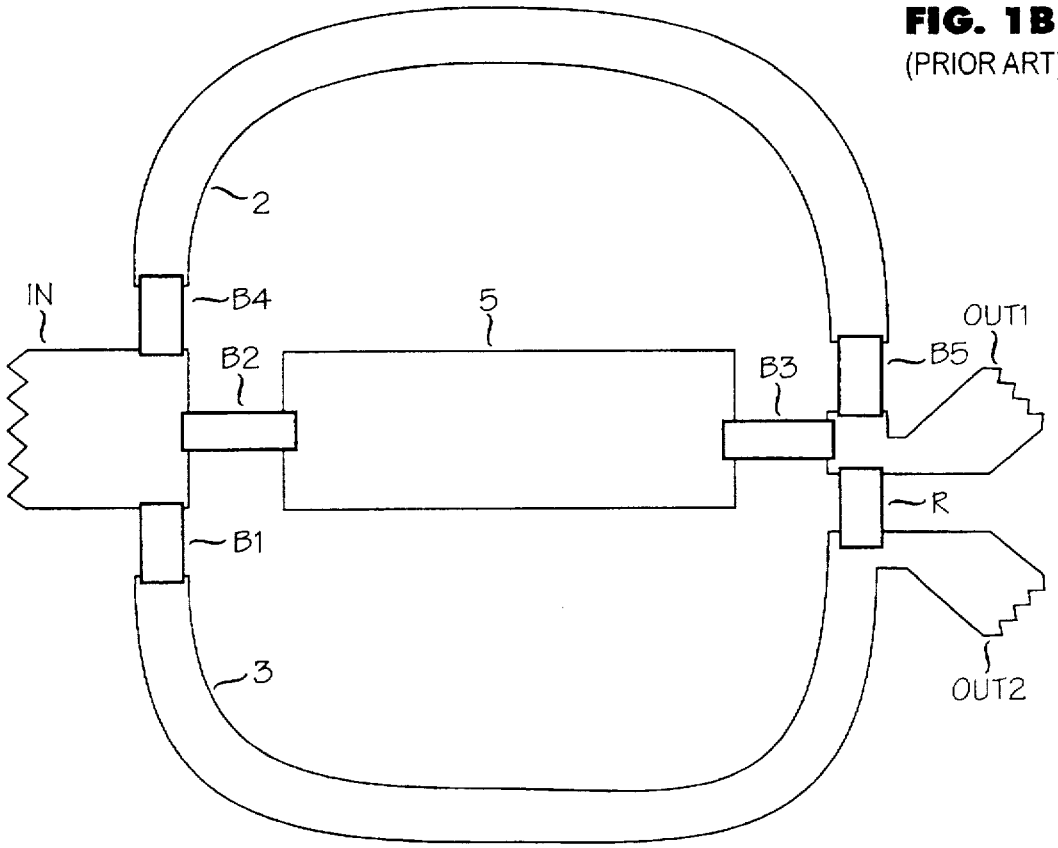
FIG. 1B (PRIOR ART)
FIG. 1B shows a prior art way of transforming the Wilkinson divider into a lossless transmission path.
Figure 2A:
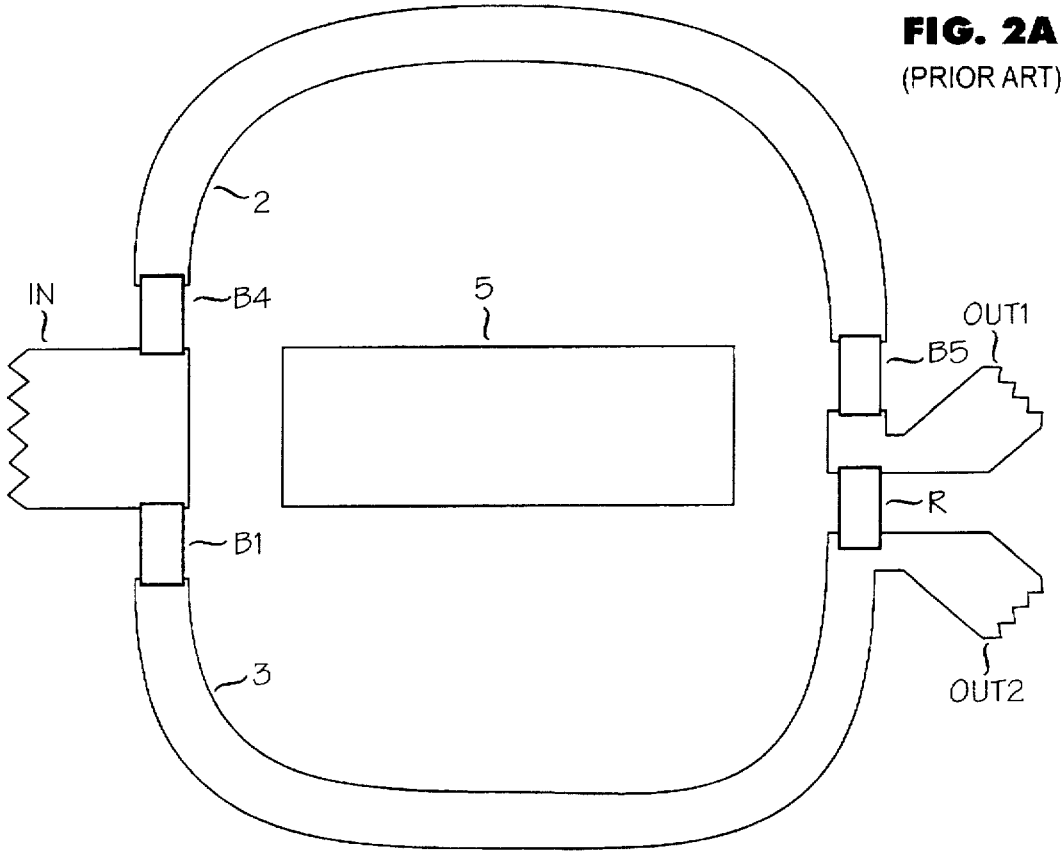
FIG. 2A (PRIOR ART)
FIG. 2A illustrates a switching device shown in FIG. 1B installed as a Wilkinson divider.
Figure 2B:
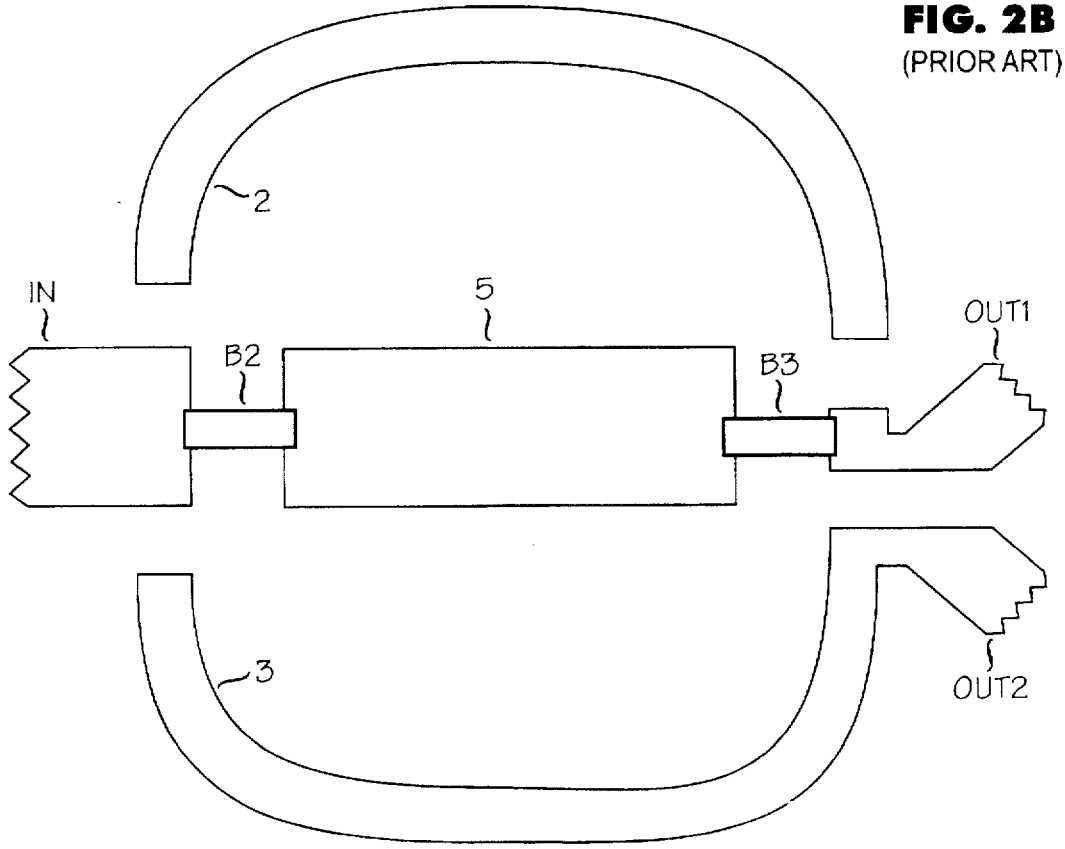
FIG. 2B (PRIOR ART)
FIG. 2B illustrates a switching device shown in FIG. 1B installed as a lossless transmission path.
Figure 3A:
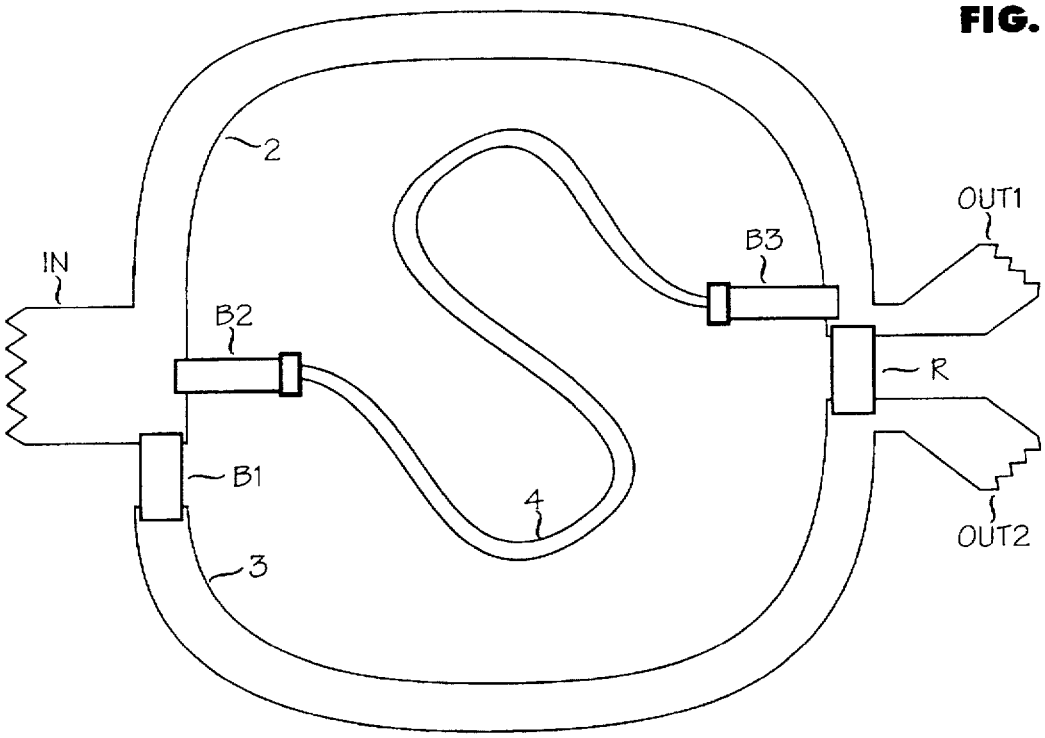
FIG. 3A shows a modified Wilkinson divider according to the invention.

The solution according to the invention is shown in FIG. 3A. It is assumed herein that $Z_1=Z_0$, but the circuit operates in the same way if $Z_1 \neq Z_0$.

The idea of the invention is to implement a transmission line with a characteristic impedance $Z_0$ by a parallel (i.e., an electrically parallel) connection of two narrow high-impedance transmission lines: one transmission line 2 with an impedance $Z_0\sqrt{2}$, which is already present in a standard Wilkinson divider, and another transmission line 4 with an impedance $2Z_0/(2-\sqrt{2})$. When $Z_0=50\Omega$) the impedance of the transmission line 2 should be about 70Ω and the impedance of the transmission line 4 about 170Ω. The latter impedance cannot be produced on most substrates without special procedures. One such procedure is to etch ground plane from under the 170Ω line 4. Another way is to place the 170Ω line 4 very close to the 70Ω line 2, whereby the interaction between the lines 2 and 4 will raise the impedance of the line 4. It would not be very harmful if the impedance were not exactly at its optimum value. For example, on a 1.6 mm FR-4 substrate or a 0.76 mm Teflon® polythelyne terephlate substrate, the maximum obtainable characteristic impedance is between 140 and 150Ω. With this impedance the standing wave ratio (VSWR) will be about 1.1.

Figure 4A:
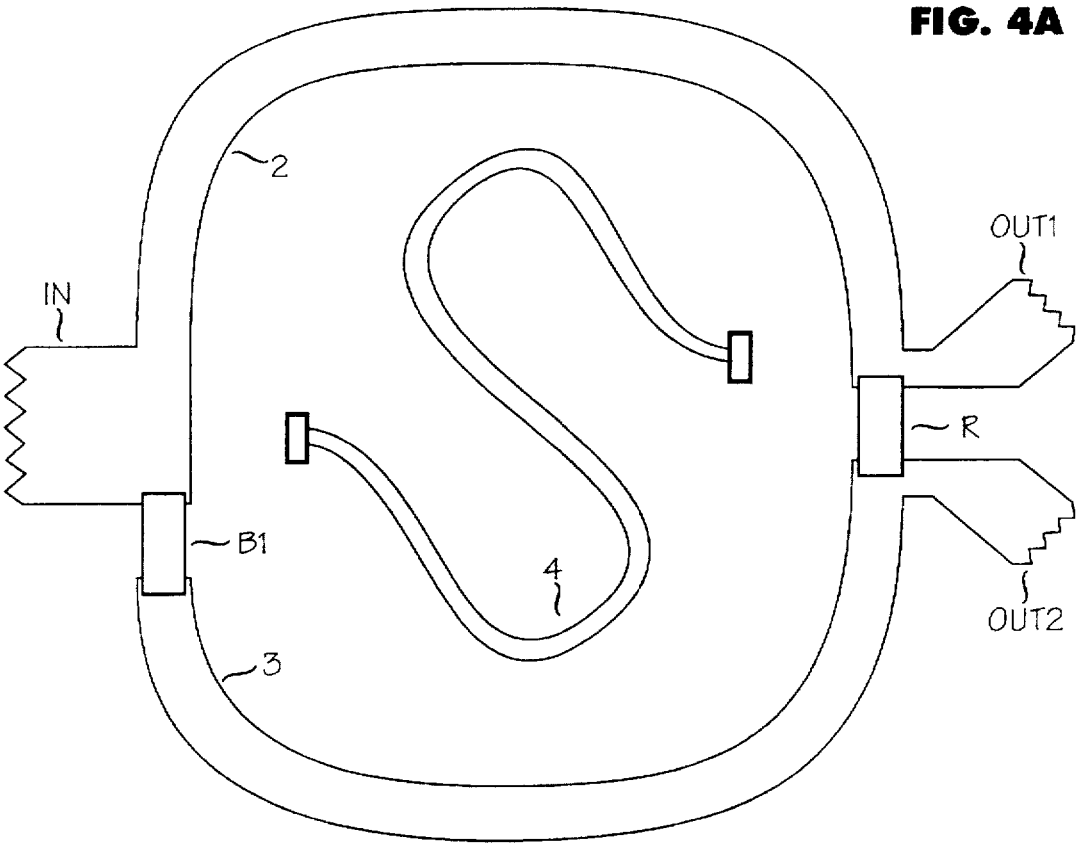
FIG. 4A shows a switching device according to the invention installed as a Wilkinson divider.

The operation of the invention is further examined on the basis of FIG. 4A. Only the bridge B1 and the resistor R are installed for the splitting operation. As the bridges B2 and B3 are not present, the both branches 2 and 3 of the Wilkinson divider are passages of the signal. The circuit operates now as a standard Wilkinson divider.

Figure 4B:
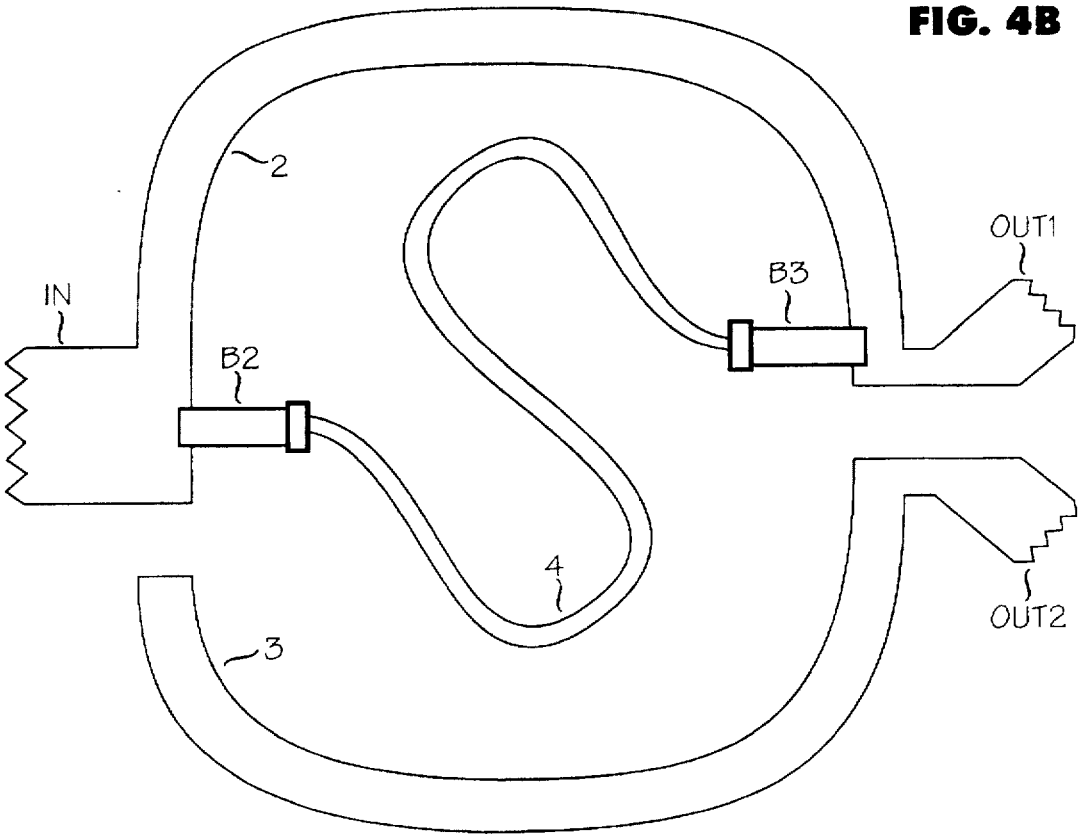
FIG. 4B shows a switching device according to the invention installed as a lossless transmission path.

Non-splitting operation is studied in FIG. 4B. The bridge B1 and the resistor R are not installed but the bridges B2 and B3 are installed. In this case, the signal meets the parallel connection of the transmission lines 2 and 4 of a quarter of wavelength, the impedances of which are $Z_0/\sqrt{2}$ and $2Z_0/(2-\sqrt{2})$, respectively. A quarter-wavelength long transmission line with the impedance $Z_0$ is produced by the parallel connection of the impedances.

Figure 3B:
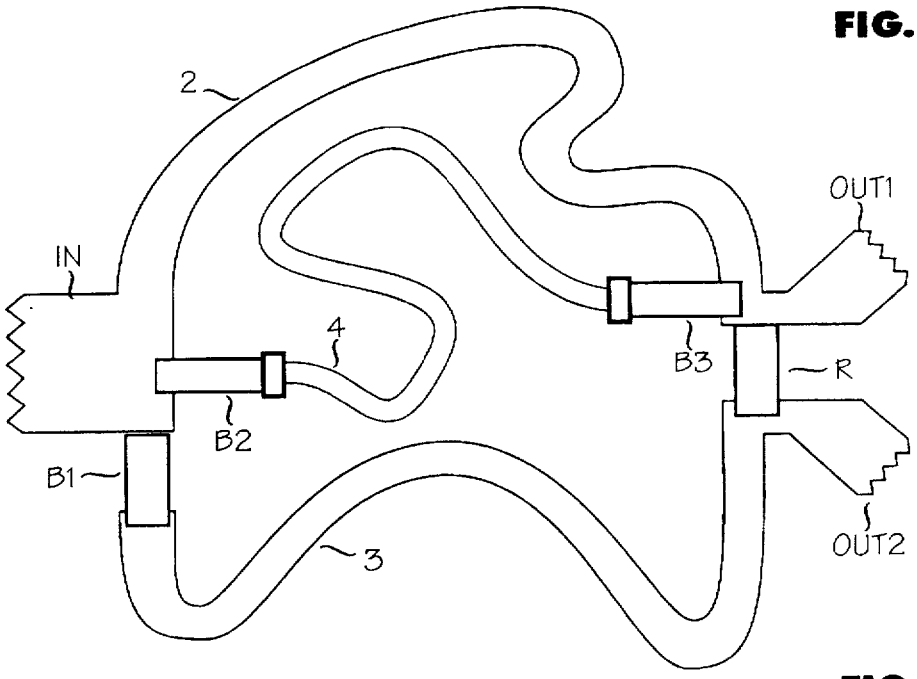
FIG. 3B shows a modified Wilkinson divider according to the invention folded into as small a space as possible.

FIG. 3B shows how a modified Wilkinson divider according to the invention can be folded in order to minimize the space it takes up on a circuit board.

Figure 3C:
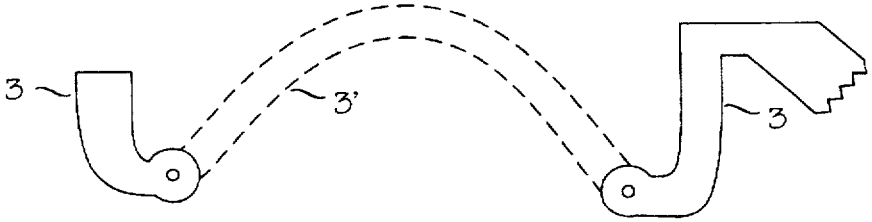
FIG. 3C shows how a coupling device can be folded so that its transmission lines are not situated in the same place.

FIG 3C shows how a coupling device can be folded so that its transmission lines are not situated on the same plane. In FIG. 3C, only transmission line 3 is shown, comprising a section 3 which has been drawn with dotted lines and which is located on a different plane than the rest of transmission line 3.

An advantage of the solution according to the invention is that the Wilkinson divider on the same circuit board can be used as required at each time both in splitting and non-splitting operation which will reduce the required number of different circuit boards. Also, in the solution according to the invention a smaller number of bridges and places for bridges are needed than in prior art solutions.

A further advantage of the solution according to the invention is that very little stray impedance is produced as bridges are needed only in high-impedance lines. Another advantage is that the extra line needed in the Wilkinson divider can easily be fitted into a limited space since the extra line is very narrow. The extra line 4 may also run close to the branch 2 in the Wilkinson divider, as long as the connection is taken into consideration in planning. See e.g. Matthaei, Young and Jones, *Microwave filters, impedance-matching networks and coupling structures*, Artech House Books, 1980, Figure 5.09-1, p. 219. By means of meandering, a quarter-wavelength long line can be placed into the available space.

In the arrangement according to the invention, a power divider, such as a Wilkinson divider, can be configured so that the same component substrate, such as a circuit board, can be used either as a power divider from one input port into two output ports or as a lossless transmission path from one input port into one output port. The changes in the way of operation cause less alterations in the circuit than in conventional solutions.

It is evident to those skilled in the art that the art according to the invention can be used in conjunction with other transmission lines, such as microstrips, suspended substrate microstrips, striplines, coaxial lines, coplanar waveguides or combinations of the above mentioned. The production of transmission lines and bridging devices is not restricted to the example described above, but the field of the invention can vary within the scope of the claims.

I claim:

1. A high frequency bypassable power divider/combiner, comprising:

a first port, a second port and a third port;

a first quarter-wavelength transmission line, connected between said first port and said second port;

a second quarter-wavelength transmission line, arranged to selectively connect said first port to said third port;

a third quarter-wavelength transmission line;

first, second and third installable bridging devices selectively located with respect to said transmission lines so that only said first and second bridging devices or said third bridging devices are operable at any one time;

a first location comprising said first installable bridging device and a second location comprising said second installable bridging device, said first and second bridging devices connecting said second transmission line between said first port and said second port, and said second port resistively to said third port, said third transmission line remaining unconnected; and third locations comprising said third installable bridging devices, said third bridging devices connecting said third transmission line electrically in parallel with said first transmission line, said second transmission line remaining unconnected.

2. The power divider/combiner according to claim 1, wherein:

said first port has a first characteristic impedance $Z_0$, said second port has a second characteristic impedance $Z_1$, and said third port has a third characteristic impedance $Z_2$, and said third quarter-wavelength transmission line has a characteristic impedance which is dimensioned so that the impedance produced by parallel connection of said transmission line and said third transmission line is substantially equal to $\sqrt{Z_0Z_1}$.

3. The power divider/combiner according to claim 1, wherein:

said total is four.

4. A power divider/combiner according to claim 2, wherein:

said first bridging device is a resistor the resistance of which is substantially equal to $2\sqrt{Z_1Z_2}$, and that the resistances of said second and third bridging devices are substantially zero.

5. The power divider/combiner according to claim 2, wherein:

the impedance of said third transmission line is raised by etching ground plane from under said third transmission line.

6. The power divider/combiner according to claim 2, wherein:

said third transmission line is placed so close to said first transmission line that interaction between said first transmission line and said third transmission line in use will raise the impedance of said third transmission line.

7. The power divider/combirier according to claim 1, wherein:

said power divider/combiner is a folded structure having both convex and concave curves in at least two of said transmission lines.

8. The power divider/combiner according to claim 1, wherein:

said power divider/combiner is a folded structure having both convex and concave curves in all of said transmission lines.

9. The power divider/combiner according to claim 1, wherein:

said power divider/combiner is a folded structure in which said transmission lines are not situated in a same plane.

10. The power divider/combiner according to claim 1, wherein: said power divider/combiner is implemented as a stripline placed on a surface of a circuit board.

* * * * *